US005372527A

United States Patent [19]

Flores Cardona

[11] Patent Number: 5,372,527

[45] Date of Patent: Dec. 13, 1994

[54] TURBO KICK BOARD

[76] Inventor: Hector D. Flores Cardona, 58 Henna Street, Urb El Cibao, Cabo Rojo, Puerto Rico, 00623

[21] Appl. No.: 6,491

[22] Filed: Jan. 21, 1993

[51] Int. Cl.[5] ..... B63H 11/12

[52] U.S. Cl. ..... 440/44; 114/153; 114/167; 440/6; 441/67

[58] Field of Search ..... 441/65, 66, 67; 114/270, 315, 153, 167; 440/89, 44, 40, 42, 7, 6

[56] References Cited

U.S. PATENT DOCUMENTS

| | | | |
|---|---|---|---|
| 2,654,335 | 10/1953 | Ball | 114/153 |
| 2,812,736 | 11/1957 | Fry | 114/270 X |
| 3,001,502 | 9/1961 | Stoker | 114/167 |
| 3,262,413 | 7/1966 | Douglas et al. | 440/89 X |
| 3,279,417 | 10/1966 | Moore et al. | 114/270 |
| 3,340,845 | 9/1967 | Tyrack | 114/270 |
| 3,416,478 | 12/1968 | Markham | 114/315 |
| 3,543,712 | 12/1970 | Vasilatos | 441/65 X |
| 4,009,677 | 3/1977 | Croisant | 440/6 |

*Primary Examiner*—Sherman Basinger
*Attorney, Agent, or Firm*—Michael I. Kroll

[57] ABSTRACT

The present invention relates to a turbo kick board. The turbo kick board includes, a base, propellers attached to the base to make the base stop and go, and a rudder attached to the base to make the base turn right and left.

6 Claims, 3 Drawing Sheets

TURBO KICK BOARD

BACKGROUND OF THE INVENTION

1. Field of the Invention

The present invention relates to a kick board.

More particularly, the present invention relates to a turbo kick board.

2. Description of the Prior Art

Numerous innovations for kick boards, have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a kick board.

More particularly, it is an object of the present invention to provide a turbo kick board that avoids the disadvantages of the prior art.

In keeping with these objects, and with others which will become apparent hereinafter, one feature of the present invention resides, briefly stated, in a turbo kick board, comprising, a base, means attached to the base to make the base stop and go, and means attached to the base to make the base turn right and left.

In accordance with another feature of the present invention, the first means are a pair of propellers.

Another feature is that the Turbo Kick Board moves from one position to another by the use of three joined forces:

a) the impulse of the person at the movement of getting over the Turbo Kick Board;

b) the amount of air compressed inside the rubber balloon; and c) the pressure of air released with the foot pedal that will rotate the propellers which will propel the water.

Another feature of the present invention is that each of the pair of propellers have three blades.

Yet another feature of the present invention is that it further comprises a propeller cover to protect the pair of propellers.

Still another feature of the present invention is that the second means is a rudder.

Yet still another feature of the present invention is that the rudder is depth adjustable.

Still yet another feature of the present invention is that it further comprises a turbo pedal.

Another feature of the present invention is that it further comprises a rudder step pedal.

Yet another feature of the present invention is that it further comprises water deflectors.

Still another feature of the present invention is that it further comprises an air valve area.

Yet still another feature of the present invention is that the air valve area contains an air valve and an air meter.

Still yet another feature of the present invention is that it has a removable top.

Another feature of the present invention is that the turbo kick board contains a rubber balloon connected to the air valve area.

Yet another feature of the present invention is that it further comprises an air conductive pipe having a first end and a second end.

Still another feature of the present invention is that it further comprises an air pressure valve connected to the first end of the air conductive pipe.

Yet still another feature of the present invention is that the first end of the air pressure valve is also connected to the rubber balloon.

Still yet another feature of the present invention is that it further comprises a propeller housing connected to the second end of the air conductive pipe.

Another feature of the present invention is that the pair of propellers are powered by an electric motor and a gear set.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
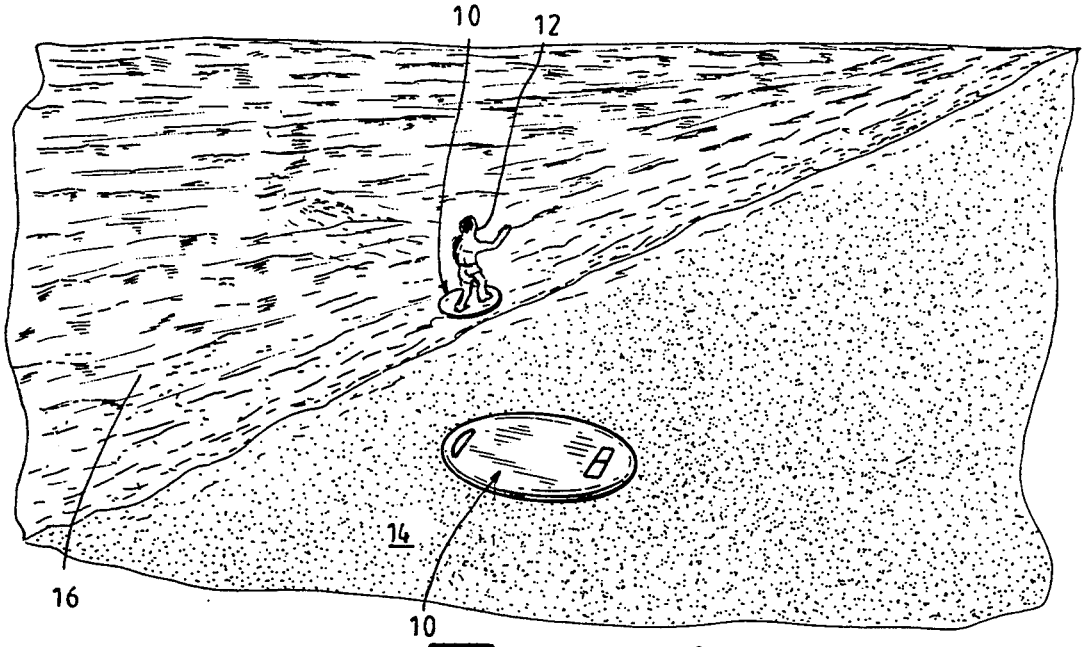
FIG. 1 is a perspective view of a person riding the turbo kick board of the present invention.

10—turbo kick board of the present invention

12—person riding the turbo kick board 10 of the present invention

14—sand

16—water

18—bottom of the turbo kick board 10 of the present invention

20—water deflectors of the turbo kick board 10 of the present invention

22—rudder of the turbo kick board 10 of the present invention

24—propeller cover of the turbo kick board 10 of the present invention

26—first propeller of the turbo kick board 10 of the present invention

26'—propeller of the alternate embodiment of the turbo kick board 10 of the present invention

28—second propeller of the turbo kick board 10 of the present invention

28'—propeller of the alternate embodiment of the turbo kick board 10 of the present invention

30—first blade of the propeller 26 of the turbo kick board 10 of the present invention

32—second blade of the propeller 26 of the turbo kick board 10 of the present invention

34—third blade of the propeller 26 of the turbo kick board 10 of the present invention

36—first blade of the propeller 28 of the turbo kick board 10 of the present invention

38—second blade of the propeller 28 of the turbo kick board 10 of the present invention

40—third blade of the propeller 28 of the turbo kick board 10 of the present invention

42—moving plate of the rudder 22 of the turbo kick board 10 of the present invention

44—stationary fork of the rudder 22 of the turbo kick board 10 of the present invention

46—vertical slot of the stationary fork 44 of the rudder 22 of the turbo kick board 10 of the present invention

47—vertical slot of the stationary fork 44 of the rudder 22 of the turbo kick board 10 of the present invention

48—bolt passing through the vertical slot 46 of the rudder 22 of the turbo kick board 10 of the present invention

50—bolt passing through the vertical slot 46 of the rudder 22 of the turbo kick board 10 of the present invention

52—top portion of the rudder 22 of the turbo kick board 10 of the present invention

54—plate disposed perpendicular to the top portion 52 of the rudder 22 of the turbo kick board of the present invention

56—aperture

58—aperture

60—first control guide of the rudder 22

62—second control guide of the rudder 22

64—arrow defining the pivotal boundaries of the rudder 22

66—arrow defining the pivotal boundaries of the rudder 22

68—dotted lines defining the depth boundaries of the rudder 22

70—top of the turbo kick board 10 of the present invention

72—turbo pedal for going and stopping of the turbo kick board 10 of the present invention

74—rudder step control for turning of the turbo kick board 10 of the present invention

76—air valve area of the turbo kick board 10 of the present invention

78—air valve of the air valve area 76

80—air pressure meter of the air valve area 76

82—collar into which air valve 78 is screwed 84—bottom hollow portion of the turbo kick board 10 of the present invention

86—top hollow portion of the turbo kick board 10 of the present invention

88—rubber balloon disposed within the turbo kick board 10 of the present invention

90—air conductor pipe of the bottom portion 84 of the turbo kick board 10 of the present invention

92—air pressure outlet of the bottom portion 84 of the turbo kick board 10 of the present invention

94—propeller housing containing propellers 26 and 28 of the turbo kick board 10 of the present invention

96—electric motor of the alternate embodiment of the turbo kick board 10 of the present invention

98—first smaller gear

100—second smaller gear

102—main gear

104—shaft connecting gear 98 and propeller 26'

106—shaft connecting gear 100 and propeller 28'

DETAILED DESCRIPTION OF THE PREFERRED EMBODIMENT

As shown in FIG. 1, a person 12 is riding in the water 16 on the turbo kick board 10 of the present invention, while another turbo kick board 10 of the present invention is resting on the sand 14.

Figure 2:
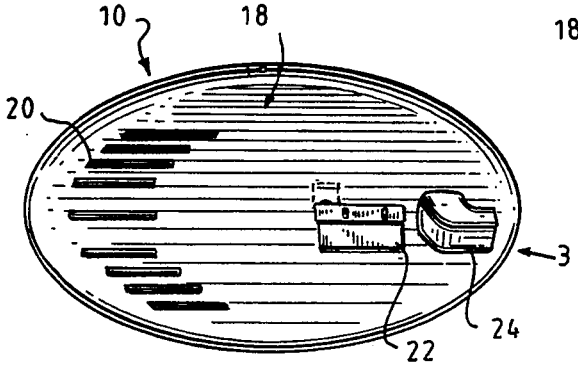
FIG. 2 is a perspective view of the bottom of the turbo kick board of the present invention.

If one were to examine FIG. 2, they would see the bottom 18 of the turbo kick board 10 of the present invention. The turbo kick board 10 is about 36" in diameter and 4" wide. On the bottom 18 of the turbo kick board 10 of the present invention are water deflectors 20, rudder 22, and a propeller cover 24.

Figure 3:
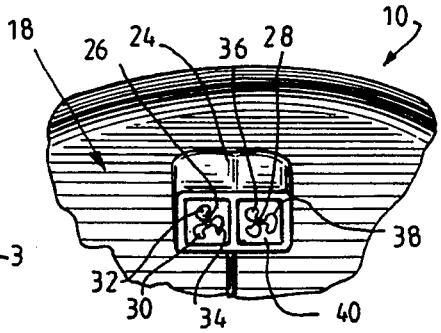
FIG. 3 is a perspective view of the rear of the turbo kick board of the present invention.

The propellers 26 and 28 can be readily seen in place in the propeller cover 24 in FIG. 3. There are two propellers 26 and 28 with each having three blades 30, 32, and 34 and 36, 38, and 40, respectively.

Figure 4:
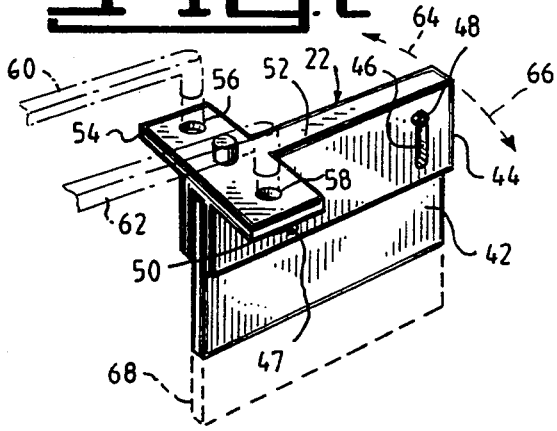
FIG. 4 is a perspective view of the rudder of the turbo kick board of the present invention.

The details of the rudder 22 are shown in FIG. 4. The rudder 22 is adjustable for depth. That is, it contains a moving plate 42 that can be raised or lowered with respect to the stationary fork 44. The stationary fork 44 contains two vertical slots 46 and 47 with bolts 48 and 50 passing through the slots 47 and 46, respectively to fasten the moving plate 42 when it has reached the desired depth. The top portion 52 of the rudder 22 contains a plate 54 disposed perpendicular to the top portion 52 and contains two apertures 56 and 58. Shown in phantom are the rudder's 22 control guides 60 and 62. Arrows 64 and 66 define the pivotal boundaries while dotted lines 68 define the depth boundaries.

Figure 5:
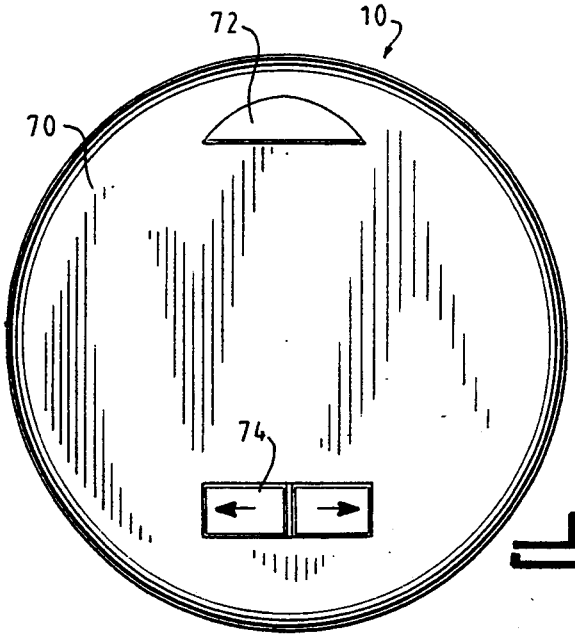
FIG. 5 is a plan view of the top of the turbo kick board of the present invention.

FIG. 5 shows the top 70 of the turbo kick board 10 of the present invention. The top 70 contains a turbo pedal 72 for going and stopping, and a rudder step control 74 for turning. Rudder step control 74 turns rudder 22 through slot 74A mounted in appendage 74B.

Figure 6:
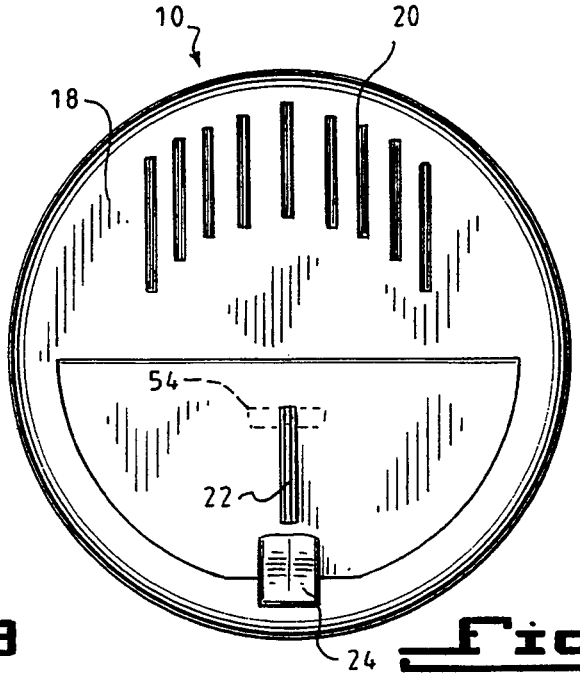
FIG. 6 is a plan view of the bottom of the turbo kick board of the present invention.

The bottom 18 of the turbo kick board 10 is shown again in FIG. 6 with its water deflectors 20, rudder 22, and propeller cover 24.

Figure 7:
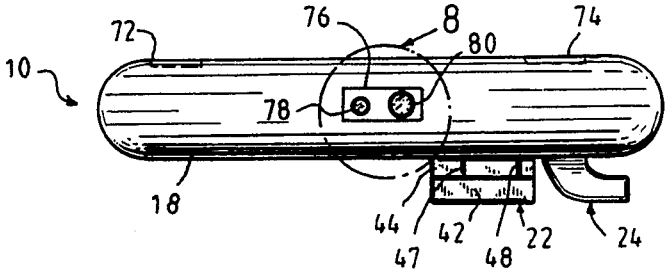
FIG. 7 is a side view of the turbo kick board of the present invention.

FIG. 7 shows a side view of the turbo kick board 10 of the present invention along with the rudder 22, the propeller cover 24, the turbo pedal 72, and the rudder stop control 74. Additionally shown is the air valve area 76 which contains an air valve 78 and an air pressure meter 80.

Figure 8:
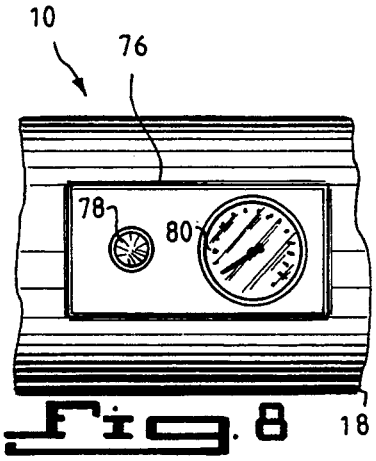
FIG. 8 is a detailed view of the area pointed to by arrow 8 of FIG. 7 of the turbo kick board of the present invention.
Figure 9:
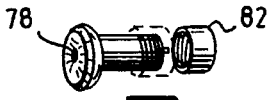
FIG. 9 is a perspective view of the valve of the turbo kick board of the present invention.

FIG. 8 shows the air valve area 76 much larger and clearer. FIG. 9 shows the air valve 78 much larger and clearer and how it screws into collar 82.

Figure 10:
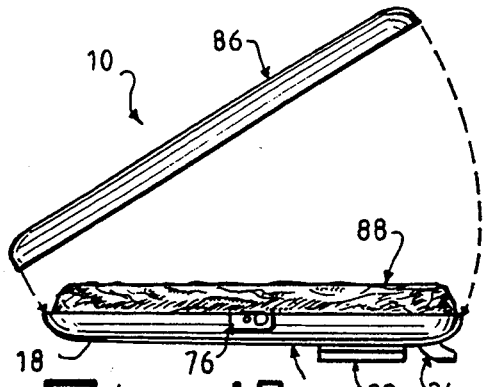
FIG. 10 is a side view of the turbo kick board of the present invention with the top half removed and the rubber balloon showing.
Figure 14:
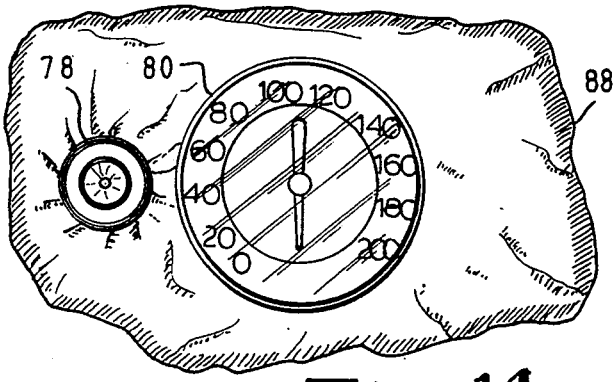
FIG. 14 is a view of the air valve area and the air meter mounted to the turbo kick board of the present invention.

The turbo kick board 10 of the present invention is hollow and separable into two parts 84 and 86, as shown in FIG. 10. A rubber balloon 88 is disposed within the turbo kick board 10 of the present invention with the air valve area 76 attached to the rubber balloon 88, as shown in FIG. 14.

Figure 11:
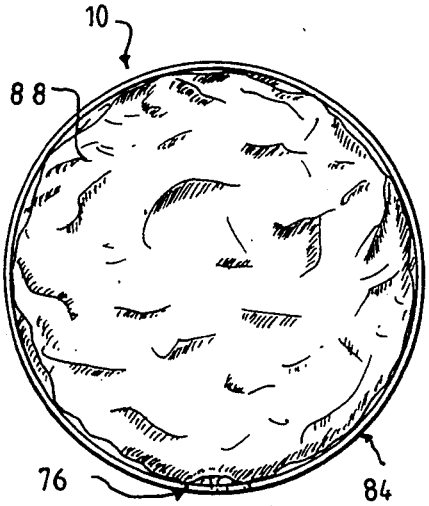
FIG. 11 is a plan view of the turbo kick board of the present invention with the top half removed and the rubber balloon showing.

As shown in FIG. 11, the rubber balloon 88 fills the entire interior of the turbo kick board 10 of the present invention.

Figure 12:
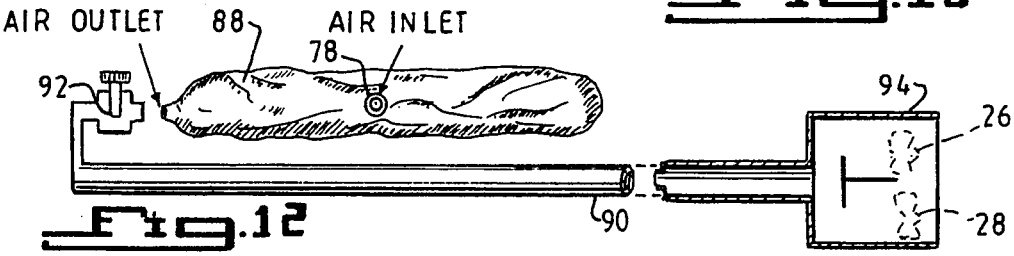
FIG. 12 is a side view of the compressed air set up used to rotate the propellers of the turbo kick board of the present invention including air pressure valve (outlet), air conductive pipe, and propeller cover.

Within the, bottom portion 84 of the turbo kick board 10 of the present invention below the rubber balloon 88 is an air conductor pipe 90 and an air pressure outlets 92, as can be seen in FIG. 12. The air conductor pipe 90 terminates in a propeller housing 94 having an outlet opening and that contains the two propellers 26 and 28 so that the rubber balloon 88 expels its air into the air-pressure valve which directs the air through the air conductor pipe 90 to the propeller housing 94 where it turns the propellers 26 and 28. Propellers 26 and 28 draw water into housing 94 through its outlet opening along its inner peripheral surface and then expels the water through the central area of the outlet opening.

Figure 13:
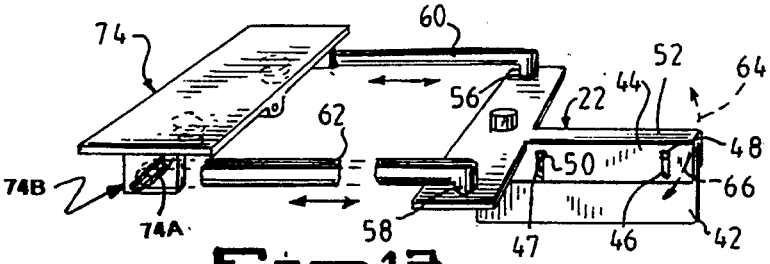
FIG. 13 is a perspective view of the pedal that operates the rudder of the turbo kick board of the present invention, and the rudder control guides.

As shown in FIG. 13 the two rudder control guides 60 and 62 lead to the rudder step control 74 from which the direction of the turbo kick board 10 of the present invention is determined.

Figure 15:
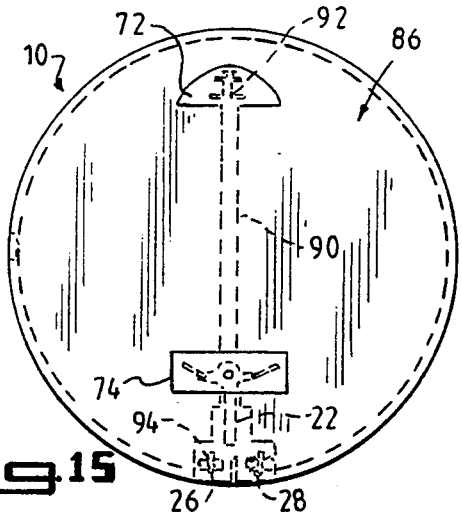
FIG. 15 is a plan view of the turbo kick board of the present invention showing the rudder and the pedal in solid lines and the rudder assembly, the propeller assembly, and the air pipe in broken lines.
Figure 16:
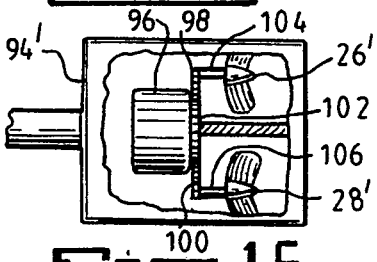
FIG. 16 is a plan view of the propeller assembly of the turbo kick board being run by an electric motor instead of compressed air.

FIG. 15 shows the top view 86 of the turbo kick board 10 of the present invention, with the turbo pedal 72, the rudder step control 74, and further shows in hidden lines the air pressure valve 92, the air conductive pipe 90, propellers 26 and 28, propeller housing 94, and the rudder 22. Air pressure valve 92 is operated by petal 72 so as to release air from balloon 88. An alternate embodiment for powering the turbo kick board 10 of the present invention is shown in FIG. 16. An electric motor 96 is connected to a main gear 102 which meshes with two smaller gears 98 and 100. Electric motor 96 can be powered in a manner well known in the art. Propeller 26' is connected to gear 98 by shaft 104 and propeller 28' is connected to gear 100 by shaft 106.

In Operation—Turbo Kick Board—Version I a) use the included scale to determine how many pounds of air are needed for the rubber balloon for your specific body weight;
b) using a bicycle tire air pump or an air compressor, fill the rubber balloon with the required amount of air determined from (a), supra;
c) place the turbo kick board on the sand about six to eight feet away from the sea water, facing toward the side you want to ride to;
d) wait until the turbo kick board is lifted by the water;
e) as soon as the turbo kick board is floating about five to six inches above the sand, run, and get on the turbo kick board;
f) put one foot on the turbo pedal and press down to get power and with the other foot step on the rudder pedal to get direction;
g) to stop, release the turbo pedal; and
h) when the air pressure decreases below operation, repeat step b), supra.

In Operation—Turbo Kick Board—Version II a) place the turbo kick board on the sand about six to eight feet away from the sea water, facing toward the side you want to ride to;
b) wait until the turbo kick board is lifted by the water;
c) as soon as the turbo kick board is floating about five to six inches above the sand, run, and get on the turbo kick board;
d) put one foot on the turbo pedal and press down to get power and with the other foot step on the rudder pedal to get direction; and
e) to stop, release the turbo pedal.

It will be understood that each of the elements described above, or two or more together, may also find a useful application in other types of constructions differing from the type described above.

While the invention has been illustrated and described as embodied in a turbo kick board, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A turbo kick board, comprising:
(a) a base;
(b) first means attached to said base to make said base stop and go, said first means being a pair of propellers, each of said pair of propellers have three blades;
(c) second means attached to said base to make said base turn right and left, said second means is a rudder, said rudder is depth adjustable;
(d) a propeller cover to protect said pair of propellers;
(e) a turbo pedal;
(f) a rudder step pedal;
(g) water deflectors;
(h) an air valve area, said air valve area contains an air valve and an air meter, said turbo kick board contains a rubber balloon connected to said air valve area; and
(i) a removable top.

2. A turbo kick board as defined in claim 1; further comprising an air conductive pipe having a first end and a second end.

3. A turbo kick board as defined in claim 2; further comprising an air pressure valve connected to said first end of said air conductive pipe.

4. A turbo kick board as defined in claim 3, wherein said air pressure valve is also connected to said rubber balloon.

5. A turbo kick board as defined in claim 4; further comprising a propeller housing connected to said second end of said air conductive pipe.

6. A turbo kick board as defined in claim 1, wherein said pair of propellers are powered by an electric motor and a gear set.

* * * * *